US012137845B2

(12) United States Patent
Granger

(10) Patent No.: US 12,137,845 B2
(45) Date of Patent: Nov. 12, 2024

(54) BOX FOR DISPENSING PRE-CUT WIPING MATERIAL WHICH CAN BE UNWOUND IN A STRIP, AND USE OF SUCH A DISPENSING BOX

(71) Applicant: Maurice Granger, Albufeira (PT)

(72) Inventor: Maurice Granger, Albufeira (PT)

( * ) Notice: Subject to any disclaimer, the term of this patent is extended or adjusted under 35 U.S.C. 154(b) by 285 days.

(21) Appl. No.: 17/638,049

(22) PCT Filed: May 28, 2020

(86) PCT No.: PCT/FR2020/050908
§ 371 (c)(1),
(2) Date: Feb. 24, 2022

(87) PCT Pub. No.: WO2021/038142
PCT Pub. Date: Mar. 4, 2021

(65) Prior Publication Data

US 2022/0279990 A1 Sep. 8, 2022

(30) Foreign Application Priority Data

Aug. 30, 2019 (FR) ..... 1909541

(51) Int. Cl.
*A47K 10/38* (2006.01)
*A47K 10/36* (2006.01)

(52) U.S. Cl.
CPC ..... *A47K 10/3827* (2013.01); *A47K 10/3643* (2013.01)

(58) Field of Classification Search
CPC ..... A47K 10/3827; A47K 10/3643
(Continued)

(56) References Cited

U.S. PATENT DOCUMENTS 3,368,522 A * 2/1968 Cordis ..... A47K 10/422 118/235
4,089,378 A * 5/1978 Suzuki ..... B65H 29/70 399/397

(Continued)

FOREIGN PATENT DOCUMENTS

EP 1181884 A1 * 2/2002 ..... A47K 10/36
FR 2960760 A1 12/2011

(Continued)

OTHER PUBLICATIONS

International Search Report dated Oct. 5, 2020 for corresponding International Application No. PCT/FR2020/050908, May 28, 2020.

(Continued)

*Primary Examiner* — Rakesh Kumar
(74) *Attorney, Agent, or Firm* — David D. Brush; Westman, Champlin & Koehler, P.A.

(57) ABSTRACT

A box for dispensing pre-cut wiping material. The box includes: a body delimiting a space for receiving the wiping material, which can be unwound in a strip on a front side of the body; a lid hinged on a rear side of the body; and a roller which is pivotably mounted on the front side of the body, which includes at least two sections of different diameters, including a first diameter and a second diameter smaller than the first diameter, and which is provided to support the strip with the lid mounted thereon. The sections of different diameters are configured to pull the strip with a speed differential, so as to tear the strip at a pre-cut line, when a user pulls on the strip from the front side of the body.

6 Claims, 4 Drawing Sheets

(58) Field of Classification Search
USPC ..... 221/45
See application file for complete search history.

(56) References Cited

U.S. PATENT DOCUMENTS

| | | | | | |
|---|---|---|---|---|---|
| 4,676,131 | A * | 6/1987 | Cassia | A47K 10/3643 | 83/649 |
| 4,738,176 | A * | 4/1988 | Cassia | A47K 10/36 | 83/649 |
| 4,846,415 | A * | 7/1989 | Jernberg | A47K 10/38 | 242/598.5 |
| 5,152,522 | A * | 10/1992 | Yamashita | B65H 27/00 | 226/185 |
| 6,302,351 | B1 * | 10/2001 | Omdoll | A47K 10/36 | 242/564.2 |
| 8,899,509 | B2 * | 12/2014 | Hjort | A47K 10/38 | 242/598.3 |
| 8,939,392 | B2 * | 1/2015 | Granger | A47K 10/34 | 242/598.5 |
| 9,265,386 | B2 | 2/2016 | Granger | | |
| 9,402,512 | B2 | 8/2016 | Granger | | |
| 9,408,505 | B2 | 8/2016 | Granger | | |
| 9,526,382 | B2 | 12/2016 | Granger | | |
| 10,046,574 | B2 * | 8/2018 | Nitta | B41J 11/04 | |
| 2004/0164085 | A1 * | 8/2004 | Kitching | B65D 83/0805 | 221/48 |
| 2013/0075417 | A1 | 3/2013 | Granger | | |
| 2013/0256450 | A1 | 10/2013 | Granger | | |
| 2015/0173572 | A1 | 6/2015 | Granger | | |
| 2015/0245745 | A1 | 9/2015 | Granger | | |
| 2019/0191939 | A1 * | 6/2019 | Hjort | A47K 10/3643 | |

FOREIGN PATENT DOCUMENTS

| | | | | |
|---|---|---|---|---|
| FR | 2966034 | A1 | 4/2012 | |
| FR | 2986957 | A1 | 8/2013 | |
| FR | 2992542 | A1 | 1/2014 | |
| FR | 2993158 | A1 * | 1/2014 | A47K 10/34 |
| FR | 2995520 | A1 | 3/2014 | |
| GB | 2126986 | A * | 4/1984 | A47K 10/36 |
| WO | WO-2011149392 | A1 * | 12/2011 | A47K 10/3643 |
| WO | WO-2011149393 | A1 * | 12/2011 | A47K 10/36 |
| WO | WO-2021038142 | A1 * | 3/2021 | A47K 10/3643 |

OTHER PUBLICATIONS

Written Opinion of the International Searching Authority dated Oct. 5, 2020 for corresponding International Application No. PCT/FR2020/050908, filed May 28, 2020.

French Search Report and Written Opinion dated Apr. 16, 2020 for corresponding French Application No. 1909541, filed Aug. 30, 2019.

English translation of the Written Opinion of the International Searching Authority dated Oct. 16, 2020 for corresponding International Application No. PCT/FR2020/050908, filed May 28, 2020.

* cited by examiner

BOX FOR DISPENSING PRE-CUT WIPING MATERIAL WHICH CAN BE UNWOUND IN A STRIP, AND USE OF SUCH A DISPENSING BOX

CROSS-REFERENCE TO RELATED APPLICATIONS

This Application is a Section 371 National Stage Application of International Application No. PCT/FR2020/050908, filed May 28, 2020, which is incorporated by reference in its entirety and published as WO 2021/038142 A1 on Mar. 4, 2021, not in English.

TECHNICAL FIELD

The present invention relates to a box for dispensing pre-cut wiping material which can be unwound in a strip, in particular non-woven material.

The invention also relates to the use of such a dispensing box.

The field of the invention is that of devices for dispensing wiping material of the type hand towel, paper towel, toilet paper or the like. Conventionally, the material can be paper, cellulose wadding, non-woven fabric, or any other material adapted for the intended application.

The material can be positioned in the device in the shape of a spool. A strip of material is unwound from the spool, then guided out of the device so that it is accessible to a user. Alternatively, the material can be positioned in the device as a block consisting of a strip folded alternately back and forth. The strip is unfolded and guided outwardly of the device so that it is accessible to a user.

PRIOR ART

The Applicant has already designed numerous devices, as described for example in documents FR2960760, FR2966034, FR2986957, FR2992542 and FR2995520.

Today, manufacturers are seeking to reduce the complexity and cost of manufacturing devices. Indeed, devices comprising many parts and/or electronic systems see their attractiveness decline.

DISCLOSURE OF THE INVENTION

The purpose of the present invention is to improve the existing devices.

Furthermore, the invention aims at providing a versatile device capable of cutting all types of pre-cut materials, even the most resistant, such as non-woven materials.

To this end, the invention relates to a box for dispensing pre-cut wiping material, the box comprising:

- a body delimiting a space for receiving the wiping material, which can be unwound in a strip on a front side of the body;
- a cover hinged on a rear side of the body; and
- a roller which is pivotally mounted on the front side of the body, which comprises at least two sections of different diameters, including a first diameter and a second diameter smaller than the first diameter, and which is provided to bearingly receive the strip surmounted by the cover; the sections of different diameters being configured to drive the strip with a speed differential, so as to tear the strip at a pre-cut line, when a user pulls the strip from the front side of the housing.

Thus, the invention allows to provide a dispensing box having a simple construction, a reduced manufacturing cost, and high reliability. The invention is effective for cutting all types of pre-cut materials.

According to other advantageous features of the invention, taken alone or in combination:

- The roller comprises at least one conical portion extending between the section of first diameter and the section of second diameter.
- The sections comprise a central section of first diameter and two side sections of second diameter.
- The roller comprises two conical portions each extending between the central section of first diameter and one of the side sections of second diameter.
- The second diameter is a locally minimal diameter of the roller.
- The roller is a part of revolution.
- The roller has an outer surface made of elastomeric material.
- The roller includes an elastomer ring defining the section of first diameter.
- The roller includes an elastomer ring defining the section of second diameter.
- The cover has a lower profile matching the outer profile of the roller, to press the strip onto the roller at each of the sections of different diameters.
- The box comprises only three distinct elements, namely the body, the cover and the roller.

Another object of the invention is the use of a dispensing box as mentioned above, equipped with wiping material which can be unwound in a strip, characterised in that when a user pulls on the strip from the front side of the body, the sections of different diameters drive the strip at a speed differential, and the strip tears at a pre-cut line.

BRIEF DESCRIPTION OF THE DRAWINGS

The invention will be better understood upon reading the description which follows, given only by way of non-limiting example and made with reference to the appended drawings wherein.

DETAILED DESCRIPTION OF THE INVENTION

Figure 1:
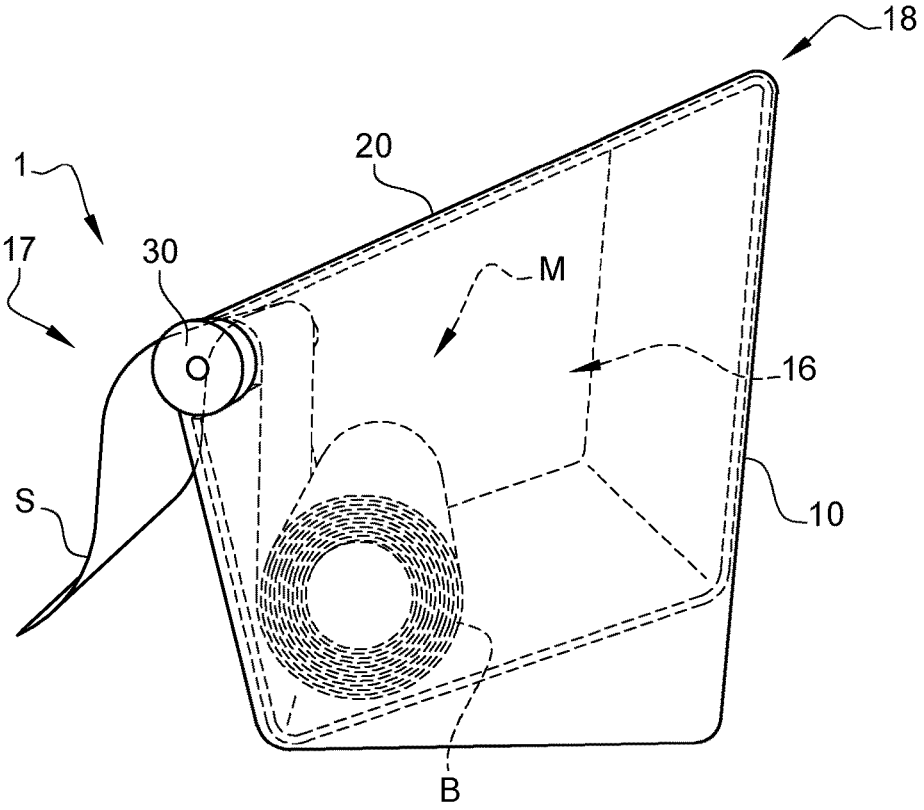
FIG. 1 is a perspective side view of a dispensing box according to the invention, equipped with a spool of wiping material which can be unwound in a strip.
Figure 2:
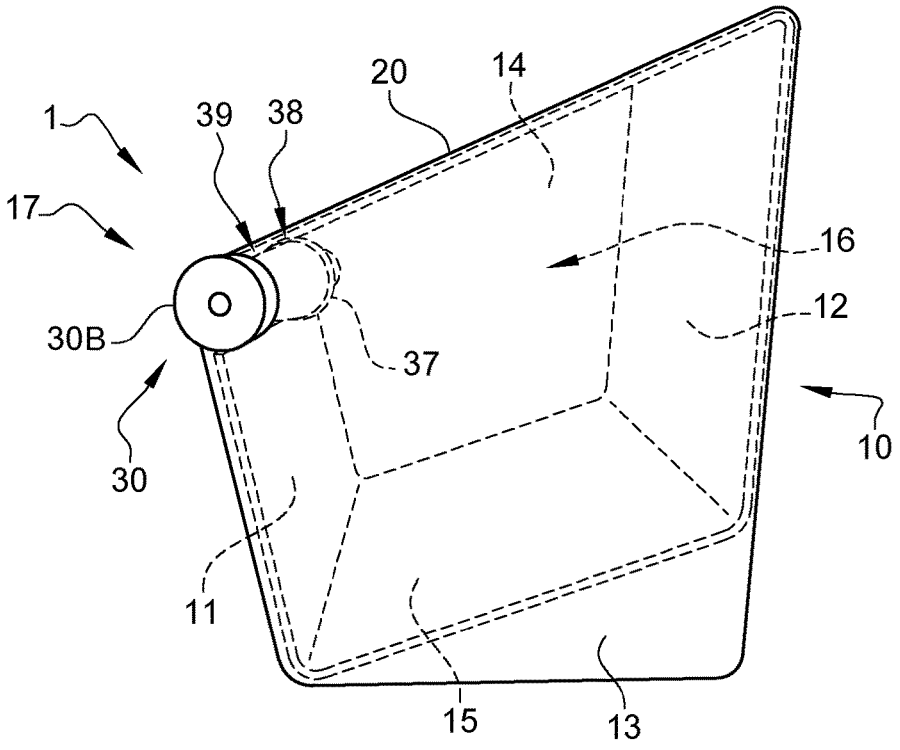
FIG. 2 is a view similar to FIG. 1, without the spool.
Figure 3:
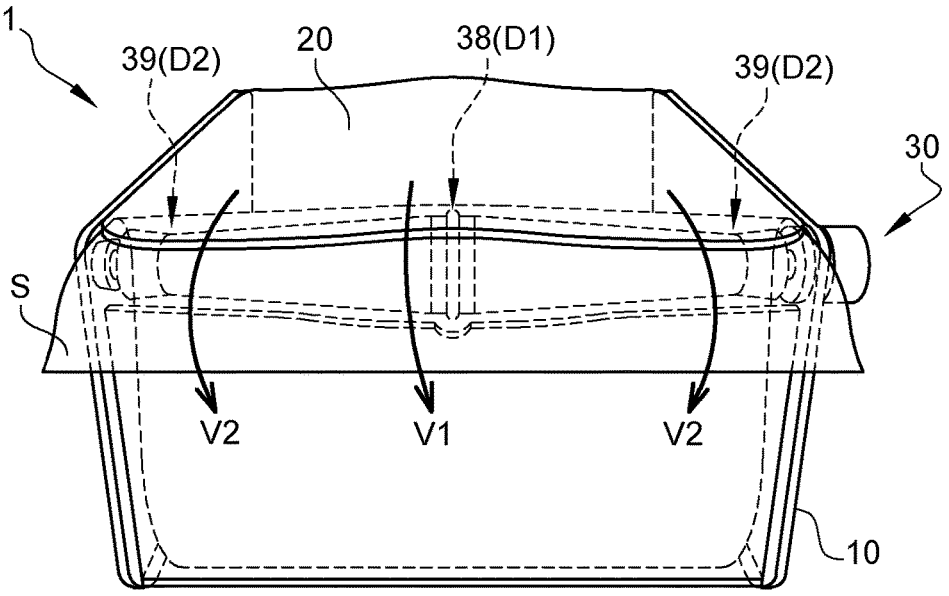
FIG. 3 is a perspective front and bottom view of the box equipped with the spool.
Figure 4:
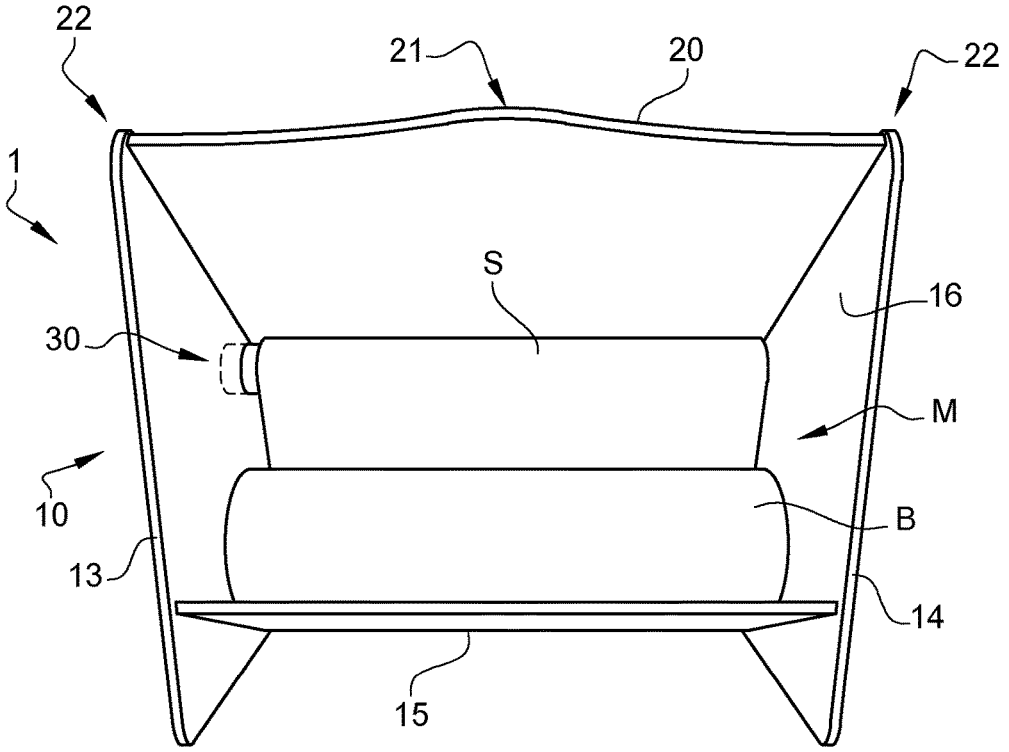
FIG. 4 is a perspective rear view of the box equipped with the spool and without a rear wall.
Figure 5:
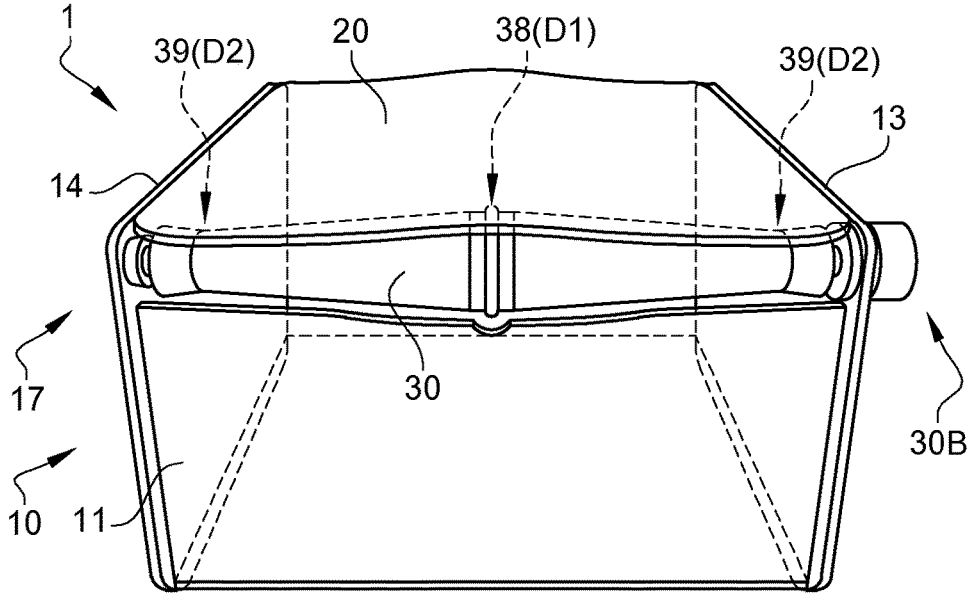
FIG. 5 is a view similar to FIG. 3, without the spool.
Figure 6:
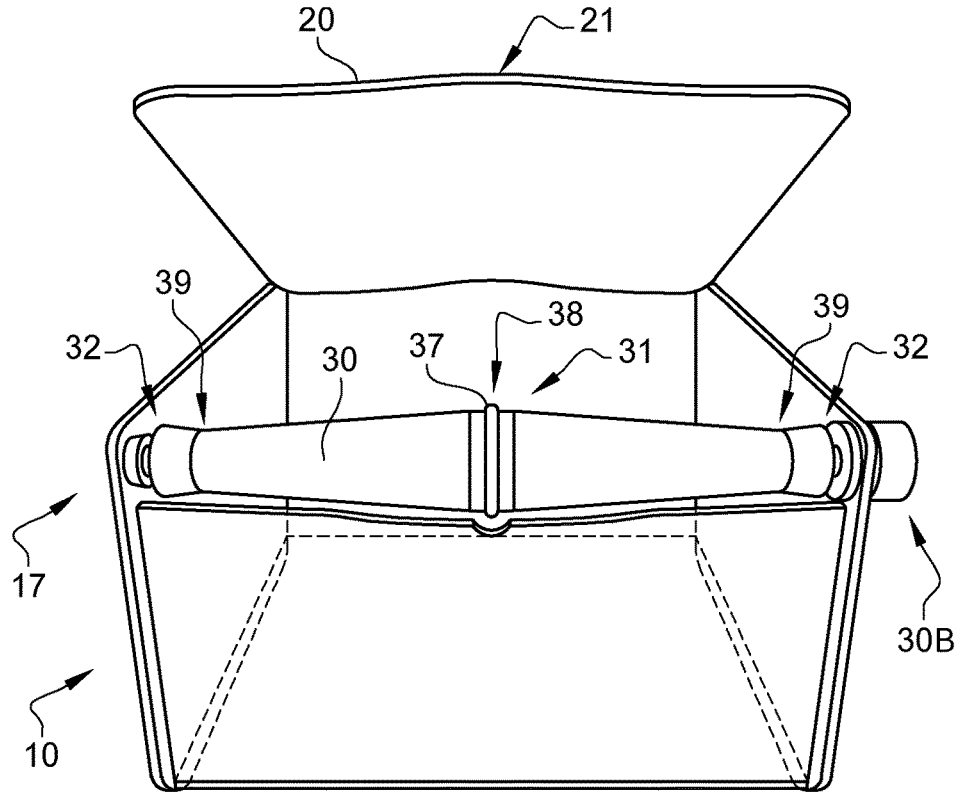
FIG. 6 is a view similar to FIG. 5, with the cover raised.
Figure 7:
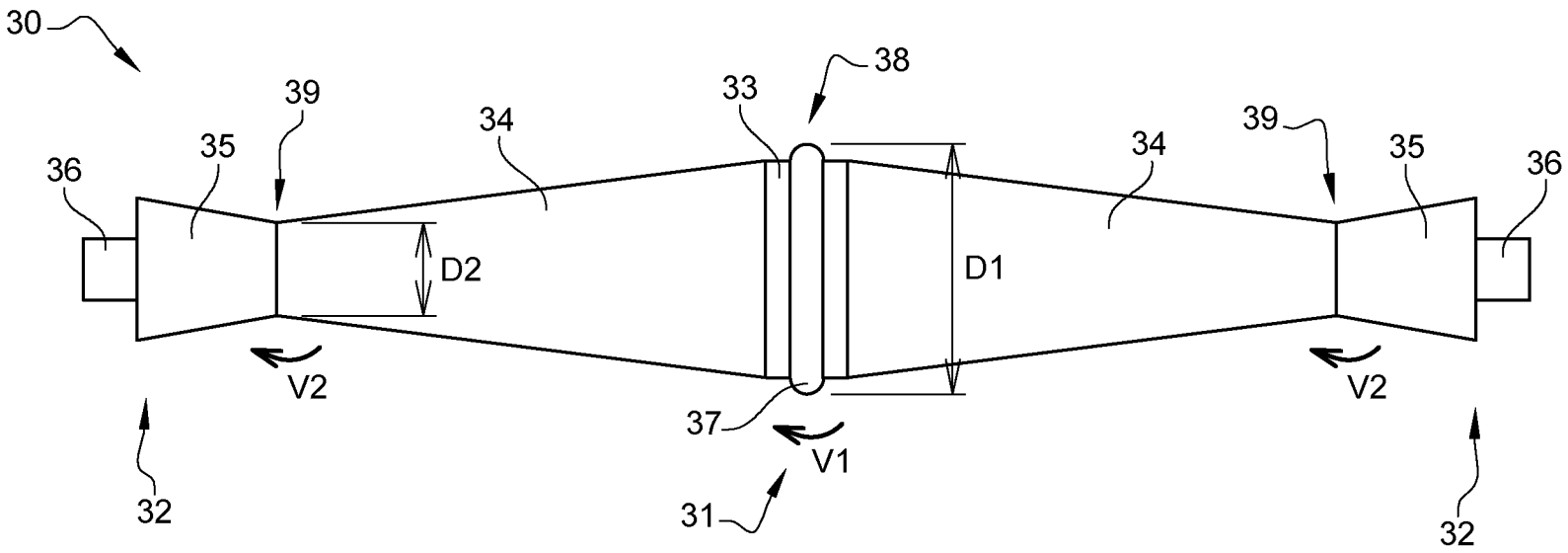
FIG. 7 is a front view of the roller equipping the box.

In FIGS. 1 to 7 is shown a dispensing box (1) according to the invention, designed to receive a wiping material (M) which can be unwound in a strip(S). The wiping material (M) is pre-cut, that is to say the strip(S) includes pre-cut lines. These lines constitute localised weakening areas, making it easier to cut the strip(S) into separate sheets.

The box (1) comprises a body (10), a cover (20), and a roller (30) for guiding the strip(S). With its reduced number of parts, the box (1) is simple, practical, economic and ecological.

The body (10) consists of five fixed walls (11, 12, 13, 14, 15) delimiting an interior space (16) for receiving the wiping material (M), in the shape of a spool (B) or a block. The body (10) includes a front wall (11), a rear wall (12), two side walls (13, 14) and a bottom wall (15). Advantageously, some or all of the fixed walls (11-15) can be constituted by a flat plate, so as to simplify the construction of the body (10) and reduce its manufacturing cost. Preferably, the body (10) is made of plastic material. The rear wall (12) can be provided with a system for attachment to a vertical support, such as a wall or a piece of furniture. The side walls (13, 14) can be shaped to serve as feet for the body (10), to place the box (1) on a horizontal support, when the box (1) is not attached to the vertical support, or when the rear wall (12) has no attachment system. The material (M) is which can be unwound in a strip(S) on a front side (17) of the body (10), between the cover (20) and the roller (30), above the front wall (11).

The cover (20) consists of a slightly domed plate in the central part (21). The cover (20) is hinged on a rear side (18) of the body (10), on the side walls (13, 14), above the rear wall (15). Preferably, the cover (20) is made of plastic material. Alternatively, the cover (20) can be made of metal or incorporate a metal portion, to adjust the pressure exerted on the strip(S) and the roller (30).

The roller (30) is pivotally mounted on the body (10) on the front side (17). The roller (30) guides the strip(S) from the spool (B) to the outside of the box (1) and the user. The roller (30) is a part of revolution. Preferably, the roller (30) is made of plastic material, with an outer surface made of elastomeric material provided to receive the strip(S).

The roller (30) comprises a central part (31) and two ends (32) mounted in pivoting connection on the side walls (13, 14) of the body (10). The central portion (31) comprises a cylindrical portion (33) and an elastomeric ring (37). On each side of the central part (31), the roller (30) comprises a conical portion (34) with a diameter decreasing towards the end (32), a conical portion (35) with a diameter increasing towards the end (32), and a side stud (36). For example, the conical portion (34) has a slope of 8°, while the conical portion (35) has a slope of 7°, relative to the central axis.

One of the studs (36) is housed in the wall (14), while the other stud (36) is housed in a button (30B) mounted on the wall (13). The button 30B is a safety button with non-return freewheel. The button 30B prevents the strip(S) from being withdrawn inwards and, by rotating, allows the strip(S) to stick out, in case there is little sticking out. This prevents the device from breaking down.

The ring (37) defines a central section (38) of maximum diameter (D1). Between the conical portions (34, 35), the roller (30) includes two side sections (39) of locally minimum diameter (D2). The diameter (D1) is greater than the diameter (D2). For example, the diameter (D1) is equal to 50 mm, while the diameter (D2) is equal to 20 mm. Preferably, the diameter (D1) is greater than or equal to twice the diameter (D2).

The box (1) is designed to cut the strip(S) pulled manually by a user. The sections (38, 39) are provided to bearingly receive the strip(S) surmounted by the cover (20). The roller (30) has three contacts on the strip(S), at the three sections (38, 39).

When a user pulls the strip(S) on the front side (17) of the body (10), the strip(S) rotates the roller (30) about its central axis. In reaction, the sections (38, 39) of different diameters (D1, D2) drive the strip(S) with a speed differential (V1, V2) therebetween. The upper section (38) of diameter (D1) drives the strip(S) with maximum speed (V1), while the sections (39) of lower diameter (D2) drive the strip(S) with a minimum speed (V2).

The invention thus allows to tear the strip(S) at a pre-cut line, starting at the central part (31). The speed differential (V1, V2) separates the formats by stretching. Another advantage is the exit dimension of the strip(S) for the grip.

Preferably, the cover (20) has a lower profile matching the outer profile of the roller (30), to press the strip(S) onto the roller (30) at each of the sections (38, 39) of different diameters (D1, D2). The weight and shape of the cover (20) can be adapted to adjust the pressure exerted on the strip (20) and the roller (30).

Moreover, the box (1) can be shaped differently from FIGS. 1 to 7 without departing from the scope of the invention, which is defined by the claims.

According to a variant not shown, the roller (30) can have only two contacts. For example, the roller (30) includes a section (38) of diameter (D1) disposed on a first side, and a section of diameter (D2) smaller than the diameter (D1) disposed on a second side. The roller (30) may include a frustoconical portion (34) between the two sections (38, 39). The sections (38, 39) of different diameters (D1, D2) drive the strip(S) with a speed differential (V1, V2) therebetween, so as to tear the strip(S) at a pre-cut line, starting at the section (38) of larger diameter.

Furthermore, the technical features of the various embodiments and variants mentioned above may be, in whole or for some of them, combined with each other. Thus, the box (1) can be adapted in terms of cost, functionality and performance.

The invention claimed is:

1. A box for dispensing pre-cut wiping material, the box comprising:

a body delimiting a space for receiving the wiping material, unwoundable in a strip on a front side of the body;

a cover hinged on a rear side of the body; and a roller pivotally mounted on the front side of the body, the roller comprising at least two sections of different diameters, including a first diameter and a second diameter smaller than the first diameter, and the roller being positioned to bearingly receive the strip between the roller and the cover;

the sections of different diameters being configured to drive the strip with a speed differential that tears the strip at a pre-cut line, when a user pulls the strip from the front side of the body, the sections comprising a central section, a first side section on a first side of the central section and a second side section on a second, opposite side of the central section, the central section having the first diameter and the first and second side sections having the second diameter smaller than the first diameter, the roller comprising first and second conical portions, each conical portion extending between the central section of first diameter and one of the side sections of second diameter, the cover having a lower profile matching an outer profile of the roller, to press the strip onto the roller at each of the sections of different diameters.

2. The box according to claim 1, wherein the roller has a surface forming a revolution about an axis.

3. The box according to claim 1, wherein the roller has an outer surface made of elastomeric material.

4. The box according to claim 1, wherein the roller includes an elastomer ring defining the section of first diameter.

5. The box according to claim 1, wherein the box comprises only three distinct elements, namely the body, the cover and the roller.

6. A method comprising:

using a dispensing box for dispensing pre-cut wiping material, the box comprising:

a body delimiting a space containing the wiping material, unwoundable in a strip on a front side of the body;

a cover hinged on a rear side of the body; and a roller pivotally mounted on the front side of the body, the roller comprising at least two sections of different diameters, including a first diameter and a second diameter smaller than the first diameter, and the roller being positioned to bearingly receive the strip between the roller and the cover;

the sections of different diameters being configured to drive the strip with a speed differential, the sections comprising a central section, a first side section on a first side of the central section and a second side section on a second, opposite side of the central section, the central section having the first diameter and the first and second side sections having the second diameter smaller than the first diameter, the roller comprising first and second conical portions, each conical portion extending between the central section of first diameter and one of the side sections of second diameter, the cover having a lower profile matching an outer profile of the roller, to press the strip onto the roller at each of the sections of different diameters;

pulling the strip from the front side of the body to unwind the strip, the sections of different diameters driving the strip with a speed differential such that the strip tears at a pre-cut line.

* * * * *